United States Patent [19]

Dahle

[11] Patent Number: 4,688,730

[45] Date of Patent: Aug. 25, 1987

[54] PAPER SHREDDER AND METHOD OF MAKING THE SAME

[75] Inventor: Gerald W. H. Dahle, Coburg, Fed. Rep. of Germany

[73] Assignee: Wilhelm Dahle Büro- und Zeichengerätefabrik, Coburg, Fed. Rep. of Germany

[21] Appl. No.: 800,720

[22] Filed: Nov. 22, 1985

[30] Foreign Application Priority Data

Nov. 23, 1984 [DE] Fed. Rep. of Germany ... 8434402[U]

[51] Int. Cl.[4] ..... B02C 18/00

[52] U.S. Cl. ..... 241/166; 29/440; 241/236

[58] Field of Search ..... 241/166, 167, 236, 243; 29/437, 439, 440

[56] References Cited

FOREIGN PATENT DOCUMENTS 2839755 3/1980 Fed. Rep. of Germany ..... 241/236
3112838 10/1982 Fed. Rep. of Germany .
3128465 1/1983 Fed. Rep. of Germany .
3239060 4/1984 Fed. Rep. of Germany .

*Primary Examiner*—Timothy V. Eley
*Attorney, Agent, or Firm*—Spencer & Frank

[57] ABSTRACT

A paper shredder cutting mechanism includes two parallel-spaced, cooperating rotary knife rollers formed of a core and an axial series of generally equidistantly spaced cutter discs affixed to the core and extending radially therefrom. The cutter discs of the two knife rollers are in an interleaving relationship with one another. Strippers are disposed between adjoining cutter discs of each knife roller and are stationarily supported. Each stripper comprises a flat, planar body having a general shape of a U lying in a plane oriented perpendicularly to the rotary axis of the associated knife roller. The planar body has two leg parts forming legs of the U and a base part forming a base of the U interconnecting the leg parts. The base part defines a cradle portion receiving the core therein. The leg parts have end portions which are remote from the base part and at which the stripper is supported. Each stripper has a bending zone situated remotely from the end portions of the leg parts and being of reduced cross-sectional area. The leg parts are bent about the bending zone to circumferentially substantially fully surround the associated core.

17 Claims, 6 Drawing Figures

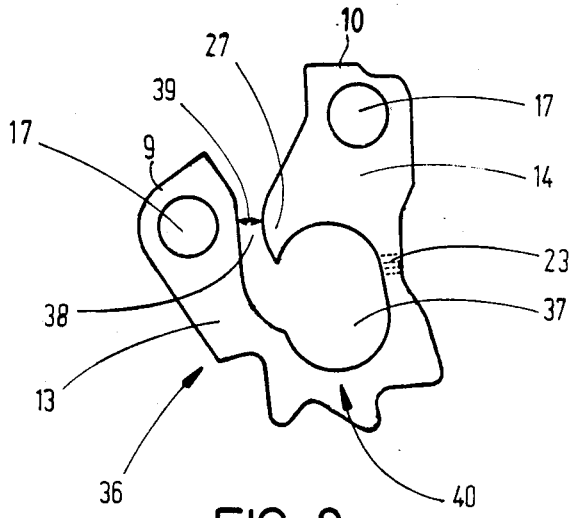
FIG. 2
FIG. 3
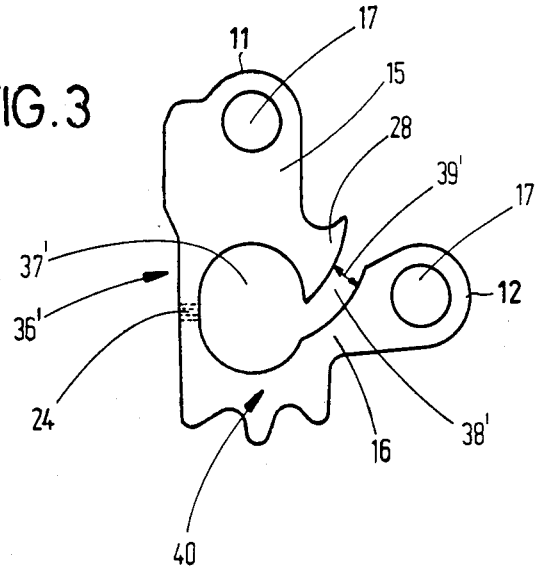

PAPER SHREDDER AND METHOD OF MAKING THE SAME

BACKGROUND OF THE INVENTION

This invention relates to a cutting mechanism for a paper shredder having two mutually cooperating, one-piece knife rollers whose cutting discs project radially beyond the cylindrical roller core and are axially equidistantly spaced. The cutting discs of the two knife rollers are in an interleaving relationship. The shredder further has strippers which extend into the space between the cutting discs and which are supported on the cutter housing externally of the knife rollers and externally of the passage zone of the material being processed.

A cutting mechanism of the above-outlined type is disclosed, for example, in German Offenlegungsschriften (patent applications published without examination) Nos. 3,112,838 and 3,128,465.

In the known structures, the strippers serve the purpose of preventing the cut strips leaving the cutting mechanism from wedging between the rotary discs of the rotary cutters and thus causing jams in the cutting region. The danger of jamming is particularly significant in those cutting mechanisms whose knife rollers operate in a "cross-cut" method. Such mechanisms thus not only cut the material into comparatively easily removable strips, but additionally sever the material into short snips which wedge particularly readily in the spaces between the rotary discs.

German Pat. No. 2,247,901, to which corresponds U.S. Pat. No. 3,860,180 and German Offenlegungsschrift No. 3,239,060 disclose cross-cutting systems in which the strippers surround the cylindrical roller cores, disposed between the rotary discs, as a closed circular ring at a comparatively small distance from the roller core. The strippers are stamped of sheet metal by punching, in one process step, a closed, circular hole in the stripper. Such a stripper construction, however, requires that the knife roller not be made of a one-piece solid material. Rather, to be able to use such a stripper design, the cutting discs must be made of parts that are separate from the roller core and must be inserted fixedly on the core with the interposition of the strippers. The strippers too, are inserted or threaded onto the roller core by virtue of their circular recesses. The required multipart configuration of the rotary cutters poses problems after a long (multi-year) use, because the close dimensional tolerances required for a highly satisfactory cutting operation cannot be maintained with sufficient reliability.

The present invention therefore improves on the known, one-piece rotary cutters made of solid material. In the known cutting mechanism employing one-piece rotary cutters, two strippers are associated with each space between two rotary discs of one and the same knife roller. The strippers are arm-shaped, oriented at approximately 90° to the direction of passage of the material being processed and fill the space between two rotary discs on the intake and outlet side, with their ends resting against the roller core, thus holding the cut strips in the region of the conveying gap and preventing them from entering into the spaces between adjoining rotary discs. Such strippers, however, are not suitable to meet the greater demands of a cutting mechanism of the cross-cut type, because they shield the roller core outwardly only over about one-half of its circumference.

SUMMARY OF THE INVENTION

It is an object of the present invention to provide a cutting mechanism of the above-mentioned type which employs rotary cutters made of a solid material and shielded against the penetration of the cut material into the spaces between the rotary discs so that the rotary cutters are suitable for operation in a cross-cut system.

This object and others to become apparent as the specification progresses, are accomplished by the invention, according to which, briefly stated, the paper shredder cutting mechanism includes two parallel-spaced, cooperating rotary knife rollers formed of a core and an axial series of generally equidistantly spaced cutter discs affixed to the core and extending radially therefrom. The cutter discs of the two knife rollers are in an interleaving relationship with one another. Strippers are disposed between adjoining cutter discs of each knife roller and are stationarily supported. Each stripper comprises a flat, planar body having a general shape of a U lying in a plane oriented perpendicularly to the rotary axis of the associated knife roller. The planar body has two leg parts forming legs of the U and a base part forming a base of the U interconnecting the leg parts. The base part defines a cradle portion receiving the core therein. The leg parts have end portions which are remote from the base part and at which the stripper is supported. Each stripper has a bending zone situated remotely from the end portions of the leg parts and being of reduced cross-sectional area. The leg parts are bent about the bending zone to circumferentially substantially fully surround the associated core.

The present invention combines the advantages of one-piece knife rollers with those of a stripper which practically completely surrounds the roller core between the individual rotary discs. The stripper is made of a stamped-out member of novel configuration; it is applied to the knife roller in a method which too, forms part of the invention.

In principle, the strippers of conventional cutting mechanisms operating according to the cross-cut method have such a configuration that they not only completely surround the roller core disposed between the rotary discs but also substantially fill the space between adjacent rotary discs of a cutter shaft outside the conveying gap for the processed material—except for the deflection troughs disposed between individual deflection teeth. In the region of the conveying gap in which the mutually cooperating rotary cutters are in an interleaving relationship to perform a scissors-like cut and where thus necessarily only the radial space between the rotary disc of the counterroller and the roller core of the rotary cutter is available for passage of the stripper ring, the stripper necessarily has a narrow section which, according to a further feature of the invention, is utilized as a bending location for bending the arms of the stripper open, and, after the stripper is applied to the cutter shaft, back into their final position, past their original position.

The fastening ends of the stripper which are fixed in a known manner by means of fastening rods extending parallel to the knife rollers are disposed on the intake side, so that the paper snips leaving the discharge side cannot accumulate in the region of the fastening rods.

According to a further feature of the invention, the roller core disposed between two rotary discs is covered annularly as completely as possible and the spaces between the rotary discs are substantially completely filled so that the strippers, when they are in their final position, have almost the same configuration as the prior art strippers employed in rotary cutters which operate according to the cross-cut system but which are not one-piece components. Since the legs of the stripper cannot be bent completely against one another, a gap of a width of approximately 0.5 mm remains. According to still another feature of the invention, paper snips entering into the gap are automatically removed by virtue of a curved gap course oriented in the direction of rotation of the respective knife rollers. The friction of the sides of the rotary discs bring such paper snips to the radially outwardly disposed outlet of the gap between the stripper legs.

The stripper is stamped from a deep-drawn steel sheet which is able to withstand the bending stresses without damage.

BRIEF DESCRIPTION OF THE DRAWING

FIGS. 2 and 3 are plan views of stamped blanks subsequently to be bent into their final position to constitute components of the preferred embodiment.

DESCRIPTION OF THE PREFERRED EMBODIMENT

Figure 1:
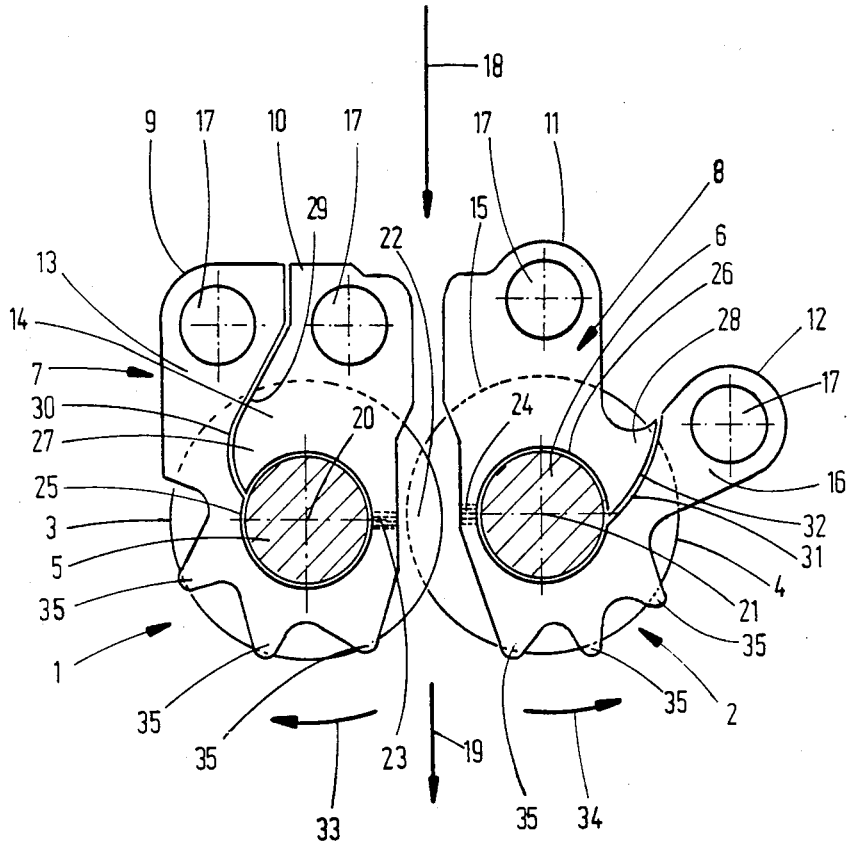
FIG. 1 is a schematic cross-sectional view of a preferred embodiment of the invention.
Figure 4:
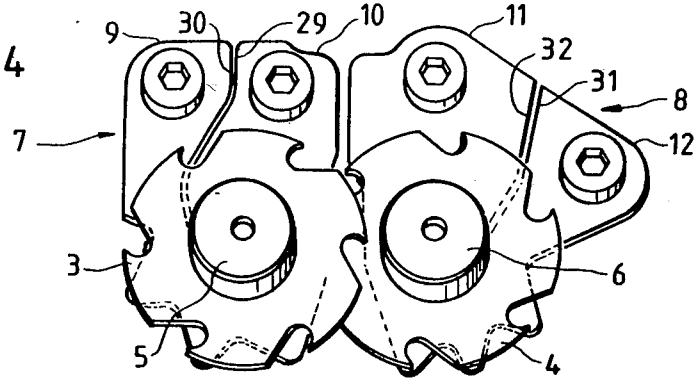
FIG. 4 is a perspective view of one end of cooperating components of the preferred embodiment.
Figure 5:
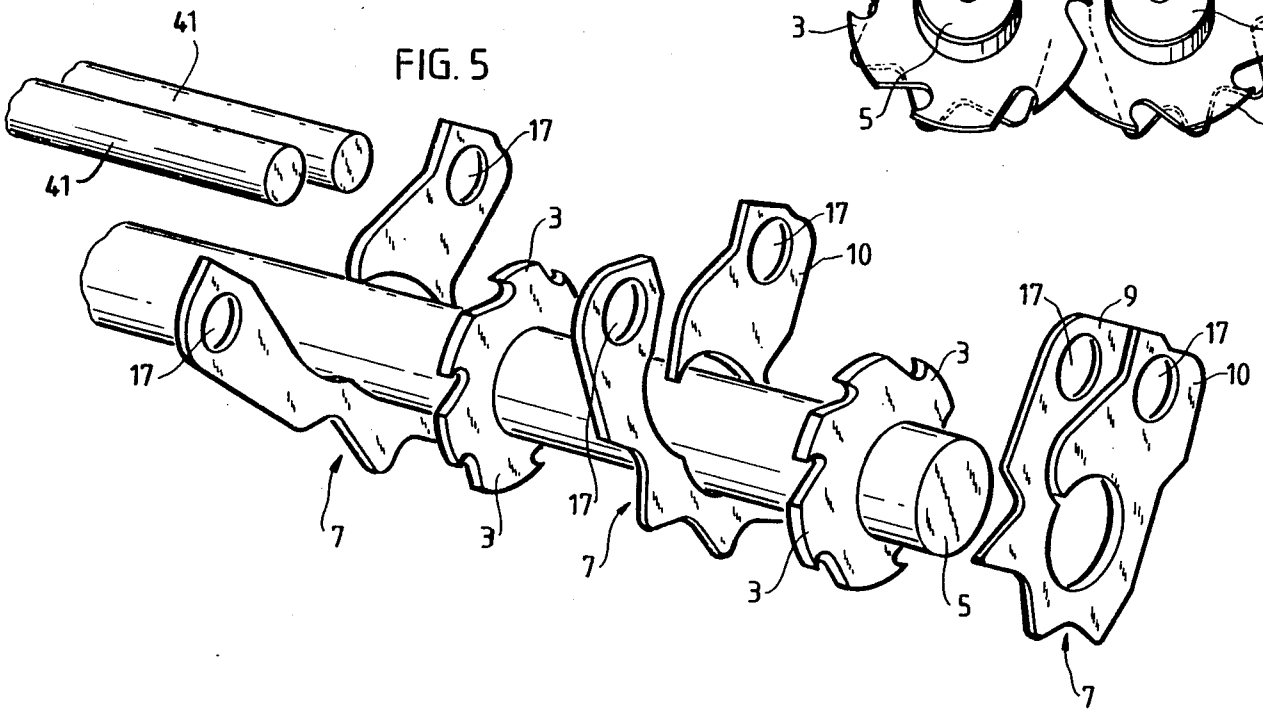
FIG. 5 is a perspective exploded view of some of the components of the preferred embodiment in an assembled state.
Figure 6:
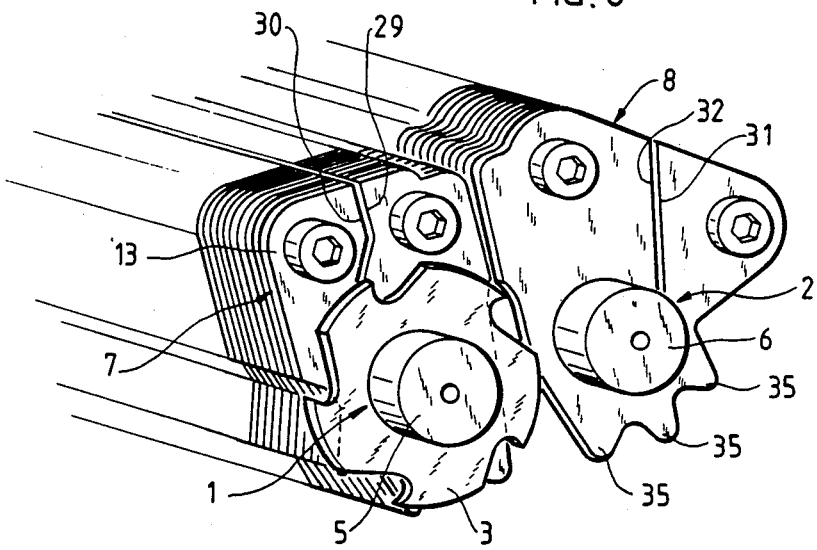
FIG. 6 is a perspective view of the preferred embodiment in a fully assembled state.

Turning to FIGS. 1, 4, 5 and 6, the cutting mechanism shown therein is composed of two one-piece rotary cutters (knife rollers) 1 and 2 whose axially serially arranged rotary discs 3, 4, which perform the cutting, project radially beyond the cylindrical roller cores 5 and 6, respectively. Any two axially adjoining rotary discs 3, 4 of each rotary cutter (knife roller) 1, 2 are approximately equidistantly spaced from one another. As viewed, for example, in FIG. 1, the rotary disc 3 of the left-hand rotary cutter 1 engages into the space between two rotary discs 4 of the right-hand rotary cutter 2. The left-hand rotary cutter 1 with its rotary discs 3 therefore constitutes the counterroller for the cutting process performed between two rotary discs 4 of right-hand rotary cutter 2.

A stripper 7 extends into the space between every two adjoining rotary discs 3, while a stripper 8 projects into the space between every two adjoining rotary discs 4. Each stripper is held at the housing (not shown) of the cutting mechanism in a region outside rotary cutters 1, 2. For this purpose, rods 41 (shown in FIG. 5) are provided which are supported by the cutter housing perpendicularly to the plane of FIG. 1 and extend parallel to the knife rollers 1, 2. The rods 41 are inserted into aligned stamped apertures 17 provided in the strippers 7, 8, in the region of free ends 9–12 of legs 13–16 of the strippers 7, 8. The free ends 9–12 of legs 13–16 lie outside the passage range of the processed material. The passage zone of the processed material or the clearance of material delivery is identified by arrows 18, 19 which indicate the direction of the material feed. Arrow 18 points towards the entrance opening of the cutting mechanism, while arrow 19 indicates the discharge direction for the paper snips.

Strippers 7, 8 are essentially U-shaped, each lying in a plane disposed at a right angle to axes 20 and 21 of the rotary cutters. Between legs 13, 14 and 15, 16 of each respective stripper 7 and 8 there lies a respective roller core 5 and 6 which is disposed between two rotary discs 3, 4 in a receiving trough formed there by the arc of the U. Thus, assuming strippers of approximately U shape, the receiving trough lies in the region of the base of the U. Each stripper 7 and 8 has a respective bending location 23 and 24 at a distance from the free ends 9–12 of the legs 13–16. In the illustrated embodiment, the bending locations 23, 24 are in the circumferential sector of roller cores 5 and 6, respectively, forming the engagement region 22 of the counterroller, so that the two legs 13, 14 and 15,16, respectively, are bent together to form a ring which almost completely surrounds the circumference of the respective roller cores 5 and 6.

The free ends 9, 10 and 11, 12 of the respective legs 13, 14 and 15, 16 of strippers 7 and 8 lie on the side of rotary cutters 1, 2 facing the entrance region 18 for the material to be cut, next to the passage region for the material being processed. This passage region is approximately defined by a plane passing perpendicularly through the plane of FIG. 1 and containing the two arrows 18, 19.

The inner edges 25, 26 of each respective stripper 7 and 8 surround the respective roller cores 5 and 6 at a short distance after the respective stripper legs 13, 14 and 15, 16 are bent together.

Legs 14 and 15 of the respective strippers 7 and 8 are provided with respective projections 27 and 28 which are oriented in the direction toward the respective other legs 13 and 16. When legs 13, 14 and 15, 16 are bent toward one another, the projections 27, 28 are situated very close to the other leg or a counterprojection (not shown) disposed thereon. The inner edges of the projections 27 and 28 form part of a circumferential ring, as related to the respective roller cores 5, 6.

The mutually facing edges 29, 30 and 31, 32 of respective projections 27, 28 and counterlegs 13, 16 lie in a conforming relationship to one another with a clearance of approximately 0.5 mm. The mutually facing edges 29, 30 and 31, 32 extend from the inner edges 25 and 26 which surround the respective roller cores 5 and 6 to at least the outer circumference of rotary discs 3, 4. The facing edges 29, 30 and 31, 32 have a curved (arc) shape which extends in the circumferential direction 33 and 34 of the associated rotary cutters 1 and 2, respectively. The arcuate course of the facing edges 29, 30 and 31, 32 extends at least over the entire region disposed between the roller cores 5, 6 and the circumference of the rotary discs 3, 4.

A plurality of radially outwardly extending stripper projections 35 are distributed over the circumference of each stripper 7, 8 between the discharge side (arrow 19) of the passage region and the respective legs 13 and 16 which are adjacent the discharge side as viewed in the direction of rotation 33, 34 of the respective knife rollers 1, 2. The flanks of stripper projections 35 oriented opposite the direction of rotation 33 and 34 enclose obtuse angles with the circumference of the respective rotary discs 3, 4.

FIGS. 2 and 3 show respective stamped out blanks 36, 36′ for forming strippers 7 and 8, respectively. Between legs 13, 14 and 15, 16, respectively, in the region of the respective base 40, 40′ of their approximate U shape, the blanks 36, 36' have a generally circular recess 37, 37' which is spread open in the direction toward legs 14 and 15, having the respective projections 27 and 28. Thus, the recesses 37, 37' are closed except for a gap 38, 38' between the projections 27 and 28 and the respective counterlegs 13 and 16. The gaps 38, 38' lie approximately diametrically opposite the respective bending locations 23, 24 (relative to the generally circular recesses 37, 37') where subsequent bending deformation takes place. Starting from the receiving trough (or cradle) for the roller cores 5 and 6, respectively, later to be formed by recesses 37, 37', the gaps 38, 38' extend outwardly between the two legs 13, 14 and 15, 16 of each respective blank 36, 36'. The width 39 of the respective gaps 38, 38' is approximately ¼ to ½ the diameter of the respective roller cores 5 and 6.

To place the blanks 36, 36' on the circumference of their associated roller core 5 and 6, respectively, gaps 38, 38' are initially bent open to the extent that the roller cores 5 and 6 can be passed therethrough radially into their inserted end positions. Thereafter, the free ends 9–12 of legs 13–16 are permanently bent back, beyond their initial position shown in FIGS. 2 and 3 into their operational end position illustrated in FIGS. 1, 4, 5 and 6. The bending deformation of the legs 13–16 takes place in the planes of FIGS. 1, 2 and 3. The arrangement of the gaps 38, 38' diametrically opposite the respective bending locations 23, 24 ensures that the strippers 7, 8 need to be outwardly deformed only to a minimum extent to receive the respective cores 5 and 6.

It will be understood that the above description of the present invention is susceptible to various modifications, changes and adaptations, and the same are intended to be comprehended within the meaning and range of equivalents of the appended claims.

I claim:

1. In a paper shredder having a cutting mechanism including two parallel-spaced, cooperating rotary knife rollers, each having a rotary axis, and being formed of a core and an axial series of generally equidistantly spaced cutter discs constituting unitary, single-piece components with the core and extending radially therefrom; the cutter discs of one of said knife rollers being in an interleaving relationship with the cutter discs of the other of said knife rollers; separate strippers being disposed between adjoining cutter discs of each said knife roller; attachment means situated at a distance from said knife rollers and externally of a passage zone for a material being processed by said cutting mechanism for stationarily supporting each said stripper; the improvement wherein each said stripper comprises a flat, planar body having a general shape of a U lying in a plane oriented perpendicularly to the rotary axis of a respective said knife roller; said planar body having two leg parts forming legs of the U and a base part forming a base of the U interconnecting said leg parts; said base part defining a cradle portion receiving a respective said core therein; said leg parts having end portions remote from said base part; said end portions being in engagement with said attachment means; and a bending zone situated remotely from said end portions of said leg parts and being of reduced cross-sectional area; said leg parts being bent in said plane about said bending zone to circumferentially substantially fully surround said core.

2. A paper shredder as defined in claim 1, wherein said bending zone is situated in a region where said cutter discs are in said interleaving relationship.

3. A paper shredder as defined in claim 1, wherein a region where said cutter discs are in said interleaving relationship defines said passage zone; said passage zone having an inlet side upstream of said cutter discs as viewed in an advancing direction of the material and an outlet side downstream of said cutter discs; said end portions of said leg parts being situated at said inlet side adjacent said passage zone.

4. A paper shredder as defined in claim 1, wherein each said stripper has an inner edge generally circularly surrounding the core and being radially spaced therefrom at a small, constant distance; said inner edge forming said cradle portion.

5. A paper shredder as defined in claim 1, wherein said strippers are stamped-out, deep-drawn sheet metal components.

6. A paper shredder as defined in claim 1, wherein a region where said cutter discs are in said interleaving relationship defines said passage zone; said passage zone having an inlet side upstream of said cutter discs as viewed in an advancing direction of the material and an outlet side downstream of said cutter discs; said knife rollers having an operative direction of rotation; each said stripper having a plurality of projections jutting radially outwardly beyond adjacent said cutter discs and being arranged in a circumferential series starting from a location adjacent said passage zone at said outlet side and extending in a direction away from said passage zone, codirectionally with the operative direction of rotation of an associated said knife roller.

7. A paper shredder as defined in claim 6, wherein said projections jutting radially outwardly have a flank oriented opposite said direction of rotation; said flank being oriented at an obtuse angle to a circumference of an adjacent said cutter disc.

8. A paper shredder as defined in claim 1, wherein at least one of said leg parts of each said stripper includes a projecting portion oriented towards a respective other leg part and being in a close positional relationship therewith.

9. A paper shredder as defined in claim 8, wherein each said stripper has an inner edge generally circularly surrounding the core and being radially spaced therefrom at a small, constant distance; said inner edge being composed of an inner edge portion belonging to said base part and inner edge portions belonging to said leg parts; said inner edge forming said cradle portion.

10. A paper shredder as defined in claim 9, wherein one of said inner edge portions belonging to at least one of said leg parts forms part of said projection thereof.

11. A paper shredder as defined in claim 8, wherein said projecting portion and said respective other leg part have mutually facing, conforming edges defining a gap therebetween.

12. A paper shredder as defined in claim 11, wherein each said stripper has an inner edge generally circularly surrounding the core and being radially spaced therefrom at a small, constant distance; said inner edge forming said cradle portion; further wherein each said cutter disc has an outer circumference; said gap defined by said facing edges extends from said inner edge at least to said outer circumference of the cutter discs.

13. A paper shredder as defined in claim 12, wherein said gap extends from a point of said inner edge which is approximately diametrically opposite from said bending location, relative to said inner edge.

14. A paper shredder as defined in claim 12, wherein each said knife roller has an operative direction of rotation; said gap of each stripper having a curvilinear course oriented in said operative direction of rotation as viewed from said inner edge towards said outer circumference.

15. A paper shredder as defined in claim 14, wherein said curvilinear course is arc-shaped from said inner edge to said outer circumference.

16. A paper shredder as defined in claim 1, wherein each core and the cutter discs mounted thereon constitutes an integral, one-piece knife roller.

17. A method of installing a stripper between two cutter discs carried on and being a unitary, single-piece component with a core of a knife roller of a paper shredder, said core having a predetermined diameter, comprising the following consecutive steps:

(a) providing a stripper blank having a general shape of a spread-open U formed of two leg parts having end portions and an interconnecting base part remote from said end portions; a bending zone situated remotely from said end portions and being of reduced cross-sectional area; said leg parts and said base part together define an inner edge having the shape of a spread-open circle; said leg parts being spaced from one another at a distance corresponding to approximately from one quarter to one half of said predetermined diameter;

(b) deforming said stripper blank by moving apart said leg parts about said bending zone for additionally spreading open said circle to widen the distance between said leg parts to an extent to permit a subsequent passage of the core therethrough in a radial direction relative to said core;

(c) inserting said core radially between said leg parts into a position in which said core is circumferentially cradled by said inner edge; and (d) deforming said stripper blank by moving said leg parts towards one another about said bending zone to and beyond an original position they assumed to obtain a final, substantially full circular course of said inner edge surrounding said core.

* * * * *